United States Patent [19]

McGuinness

[11] Patent Number: 4,700,526

[45] Date of Patent: Oct. 20, 1987

[54] ROOFING SHINGLE SEPARATING AND LAYING MACHINE

[76] Inventor: Mario F. McGuinness, 7519 Ponce Ave., Canoga Park, Calif. 91304

[21] Appl. No.: 2,747

[22] Filed: Jan. 12, 1987

[51] Int. Cl.[4] ..... E04D 15/02

[52] U.S. Cl. ..... 52/749; 52/748

[58] Field of Search ..... 52/747, 748, 749, 518, 52/127.5, 127.1

[56] References Cited

U.S. PATENT DOCUMENTS

| | | | |
|---|---|---|---|
| 3,093,936 | 6/1963 | Figge | 52/749 X |
| 3,122,862 | 3/1964 | Figge | 52/749 X |
| 3,245,192 | 4/1966 | Hilson | 52/748 X |
| 3,438,170 | 4/1969 | White | 52/749 X |
| 3,566,562 | 3/1971 | White | 52/748 X |
| 3,769,916 | 11/1973 | Hogan | 52/749 X |
| 4,043,093 | 8/1977 | Riggs | 52/749 |
| 4,068,446 | 1/1978 | Brueske | 52/747 |

*Primary Examiner*—J. Karl Bell

*Attorney, Agent, or Firm*—William W. Haefliger

[57] ABSTRACT

Roofing apparatus comprises:

(a) a longitudinally elongated blade having a laterally presented sharp edge section adapted to initially penetrate between two stacked shingles, and a laterally presented thickened edge section adapted to spread the two shingles as the blade further penetrates laterally therebetween, (b) and structure to separate one of the two relatively spread shingles from the other by movement of the one shingle in a direction generally parallel to the other.

Other mechanism allows feeding of the shingles, successively, off the apparatus and onto a roof.

15 Claims, 20 Drawing Figures

FIG. 4.
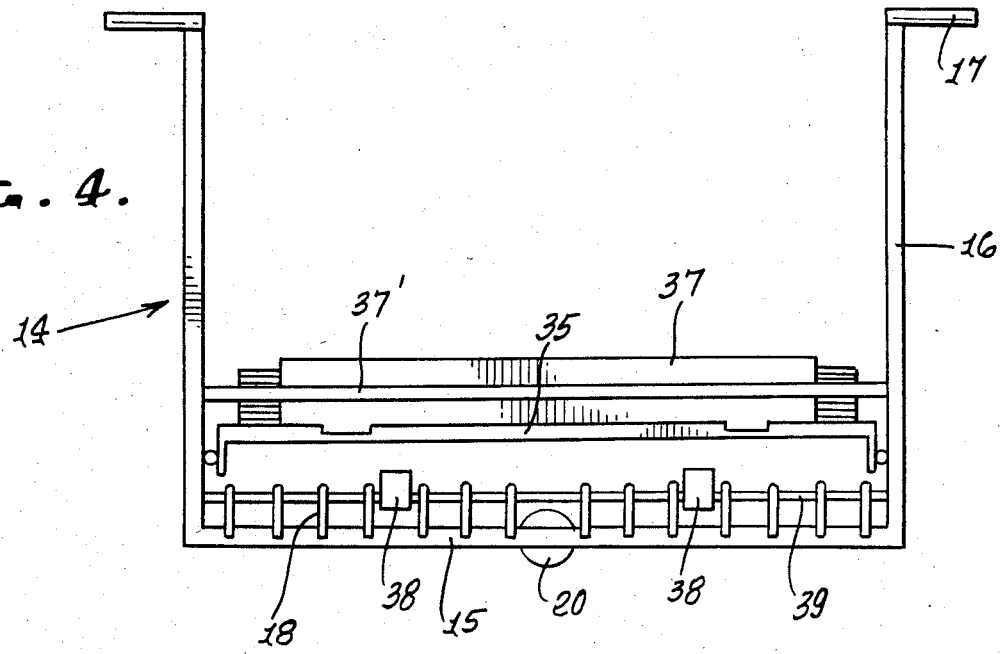
FIG. 5.
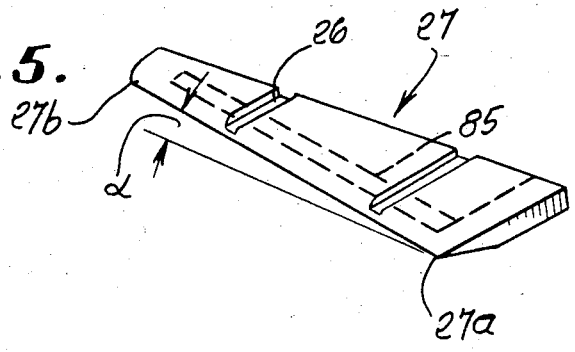
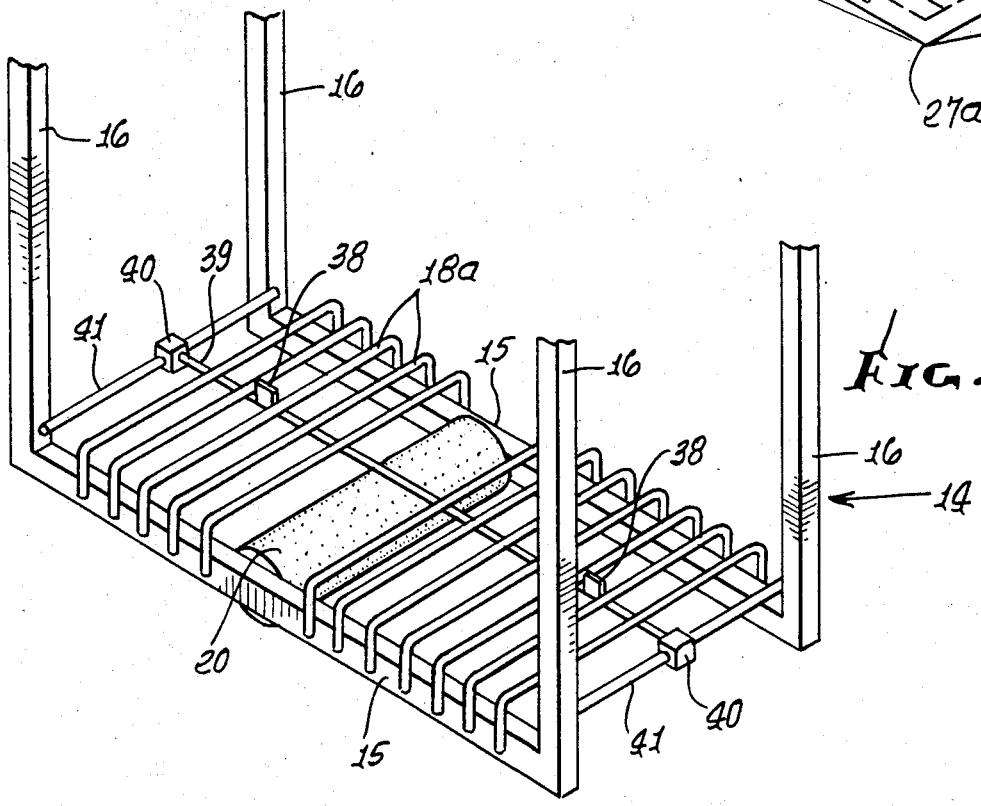
FIG. 10.

ROOFING SHINGLE SEPARATING AND LAYING MACHINE

BACKGROUND OF THE INVENTION

This invention relates generally to application of roofing shingles, and more particularly to apparatus movable along a roof and operable to sequentially and automatically dispense shingles from a stack into laid positions on the roof, and also to fasten them to the roof.

Shingling of roofs is commonly done by roofers who walk upon the roof and hand carry the shingles into position for laying; they then position the shingles by hand, and fasten or nail them to the roof, by hand. These operations are time consuming and very expensive so that the cost of re-roofing homes is commonly prohibitive. There is need for automated roofing techniques and apparatus that will substantially reduce such costs, and greatly speed up the time required to shingle a roof.

SUMMARY OF THE INVENTION

It is a major object of the invention to provide apparatus and methods to meet the above needs.

Basically, the apparatus of the invention comprises:

(a) a longitudinally elongated blade having a laterally presented sharp edge section adapted to initially penetrate between two stacked shingles, and a laterally presented thickened edge section adapted to spread the two shingles as the blade further penetrates laterally therebetween, (b) and means to separate one of the two relatively spread shingles from the other by movement of the one shingle in a direction generally parallel to the other.

The blade to accomplish such inter-shingle penetration and spreading typically incorporatesmeans for heating the blade so as to enable transfer of heat from the blade to the shingles to ease penetration and spreading, as when the stacked shingles are cold. Also, shingle spreading is facilitated by making the thickened section of the blade forwardly convex, as will appear.

The means to separate the shingles one from another may typically include a pusher to push said one shingle in said direction after the blade has initially penetrated between the two shingles, and a carriage carrying said pusher and said blade, the pusher supported for cyclic movement on a carriage, and laterally relative to the longitudinal direction of carriage movement on the roof. Thus, the pusher and blade may be interconnected so that when the pusher is moved in one lateral direction, the blade moves in the opposite lateral direction, whereby the blade retracts relative to the shingles as the pusher pushes said one shingle laterally to discharge off one side of the carriage.

The carriage typically includes means such as a roller supporting the frame for transport longitudinally along a roof. The roller may have an elastomeric surface to frictionally grip the sloping roof; and a shingle stapler is carried by the frame in a position to staple to the roof said one shingle after it has been pushed by the pusher in said direction to free the one shingle from the frame.

These and other objects and advantages of the invention, as well as the details of an illustrative embodiment, will be more fully understood from the following specification and drawings, in which:

DRAWING DESCRIPTION

FIG. 4 is a side view of the apparatus, looking in the direction 4—4 of FIG. 3;

FIG. 5 is a perspective view of a blade component of the FIG. 2 apparatus;

Figure 9:
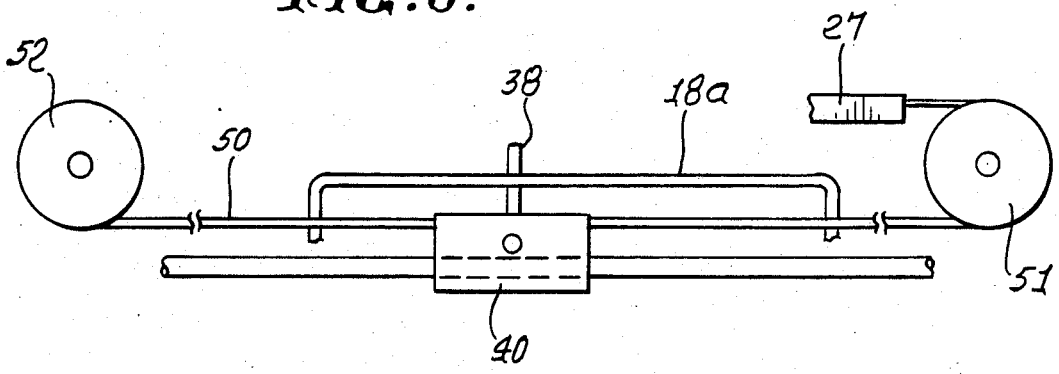

FIGS. 6, 7, 7*a* and 8*a*–8*d* are schematic views of blade operation to separate and spread shingles in a stack; and FIG. 9 is a side elevational view of a shingle pusher, and associated mechanism;

FIG. 10 is a perspective view showing pusher means movable laterally to push shingles along support bars; and FIGS. 11 and 12*a*–12*e* are further schematic views.

DETAILED DESCRIPTION

Figure 1:
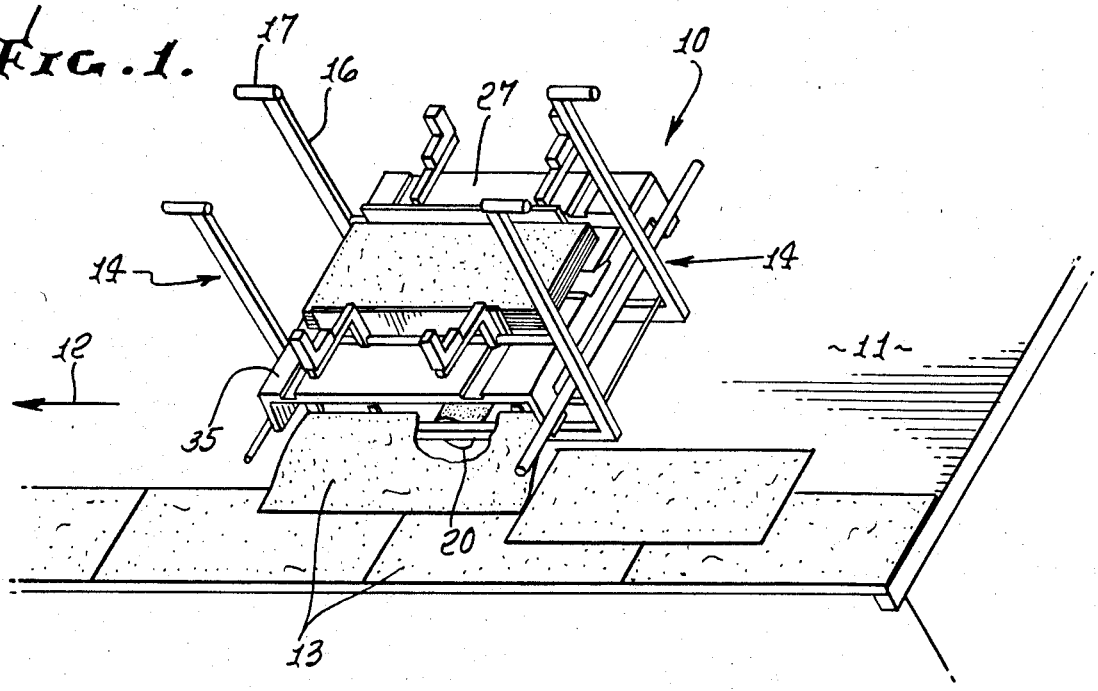
FIG. 1 is a perspective view of a roof, with roofing apparatus of the invention moving thereon, to lay shingles.

In FIG. 1, the roofing apparatus is shown at 10 movable along a roof 11, in longitudinal direction 12. It discharges rectangular shingles 13 laterally to the roof, in positions to be attached to the roof. As will later appear, the apparatus may also attach the shingles to the roof, as by stapling. Shingles are also referred to as tiles, herein.

Figure 3:
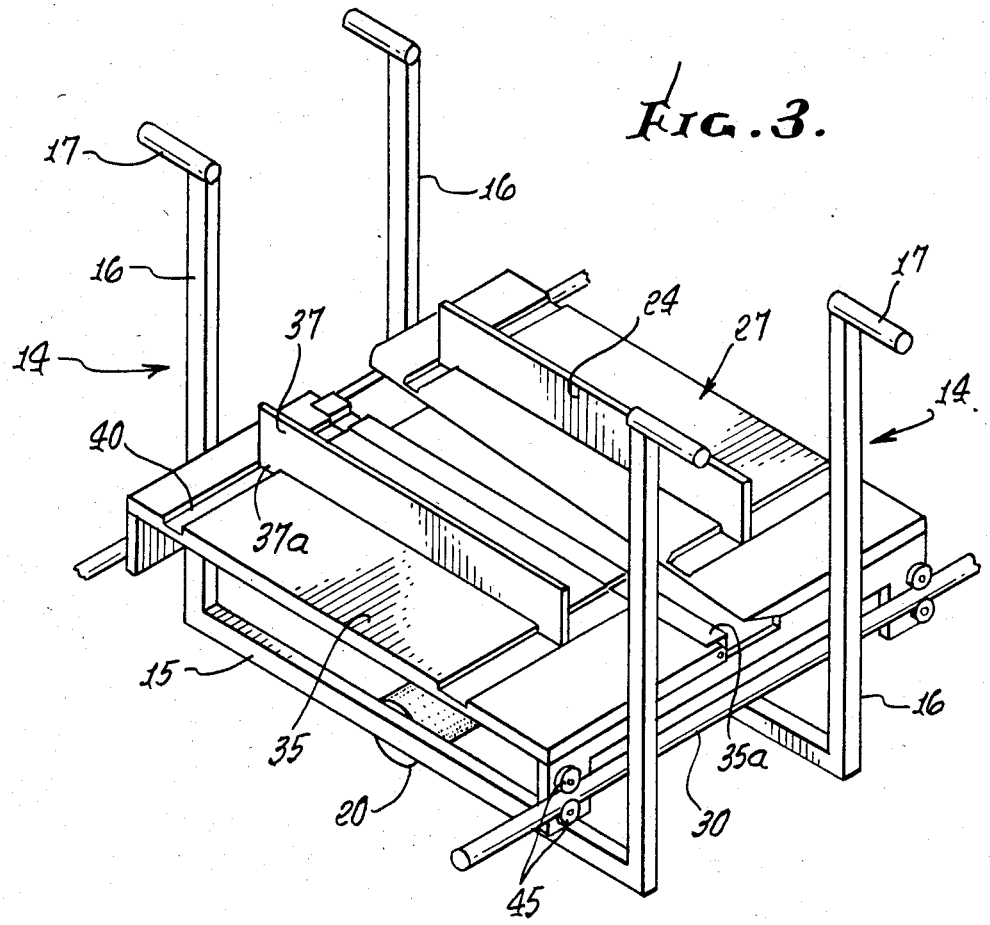
FIG. 3 is another view of the FIG. 2 device with some parts removed to show operation of other parts.
Figure 2:
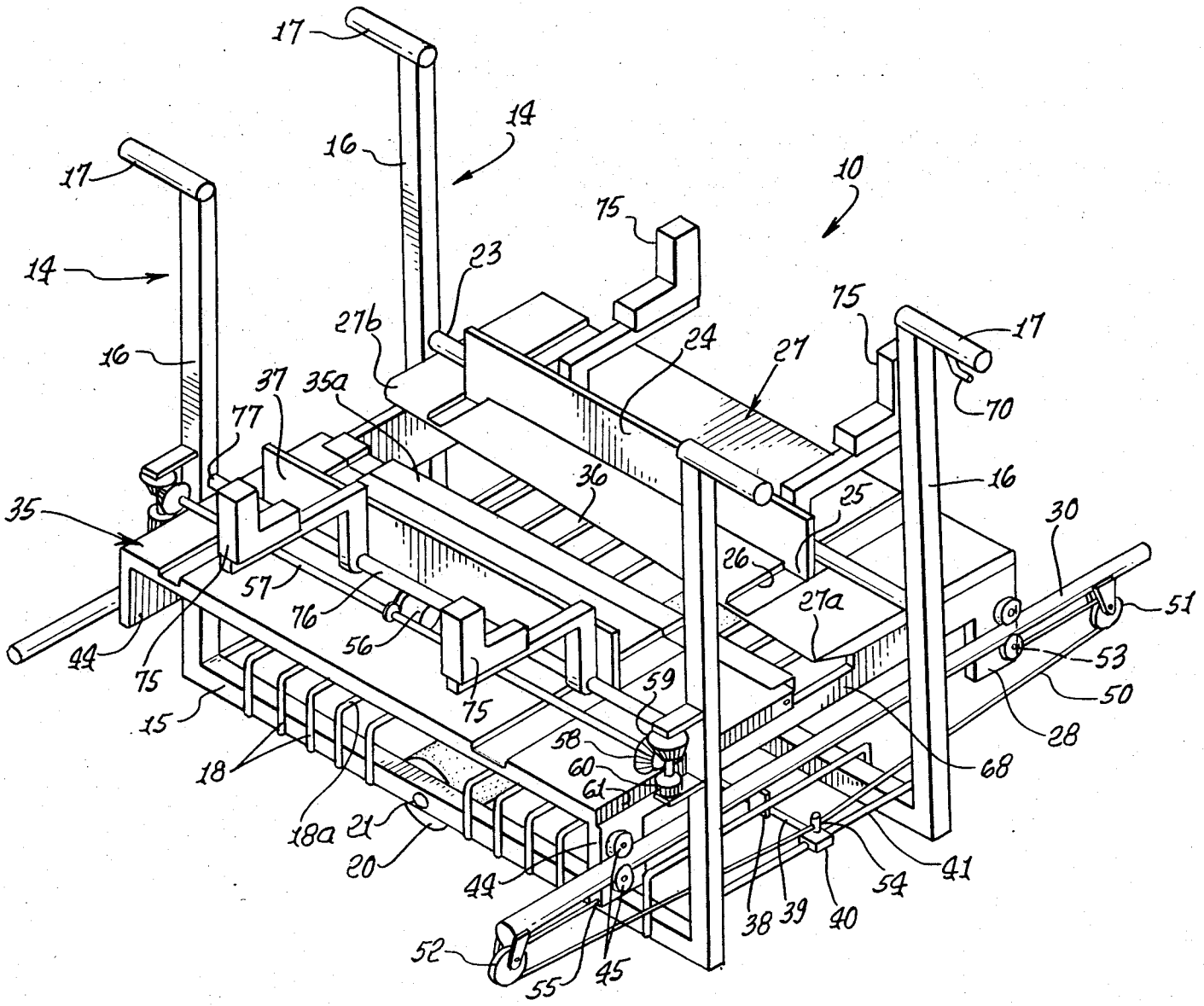
FIG. 2 is an enlarged perspective view of the roofing apparatus.
Figure 7:
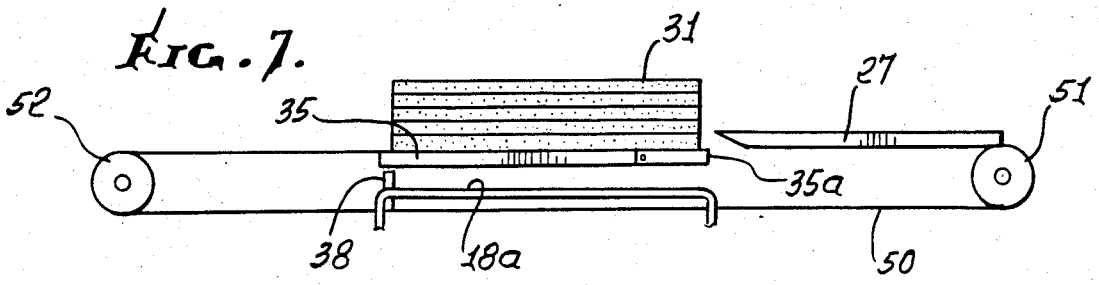
Figure 7A:
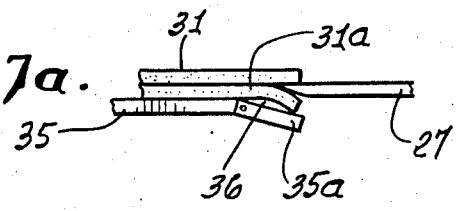
Figure 8A:
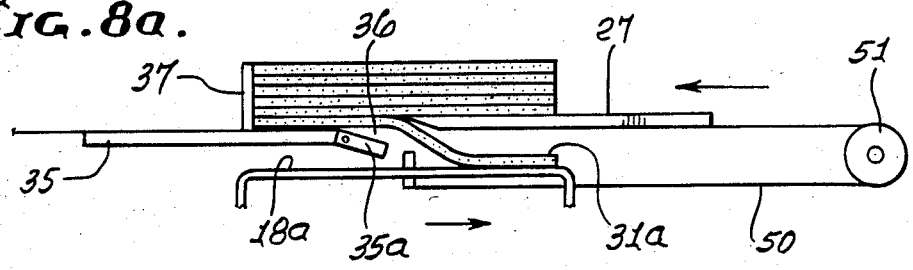
Figure 8B:
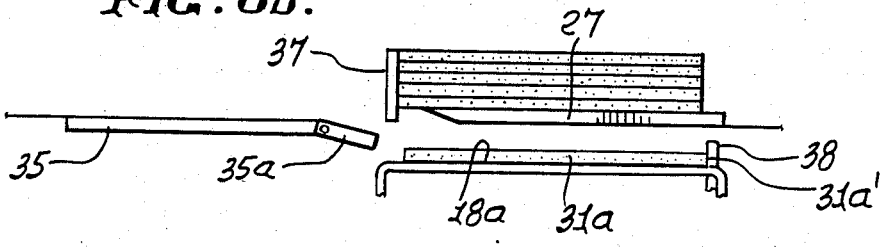
Figure 8C:
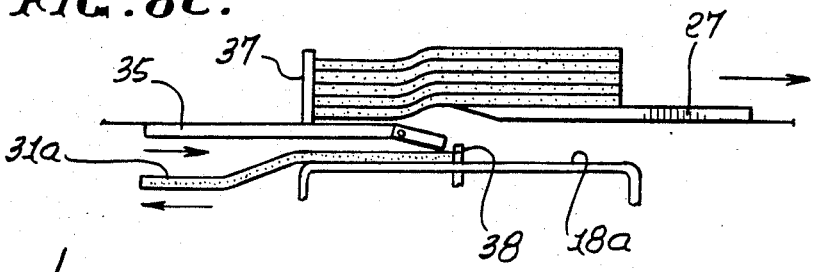
Figure 8D:
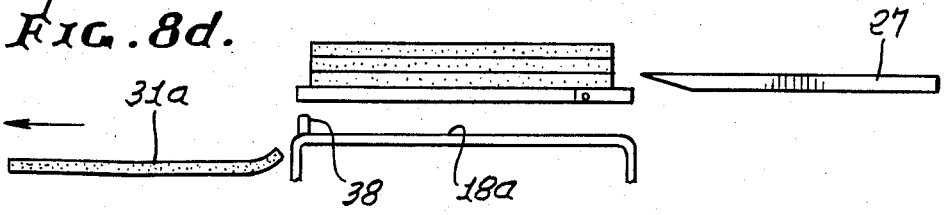
Figure 12A:
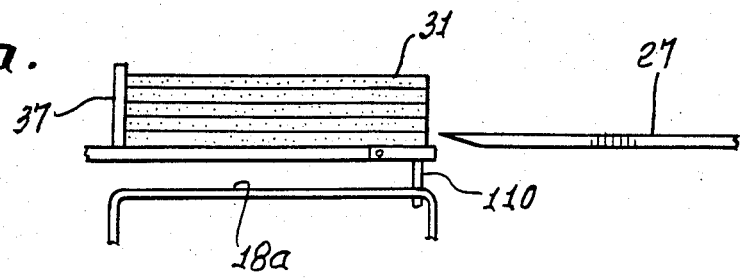
Figure 12B:
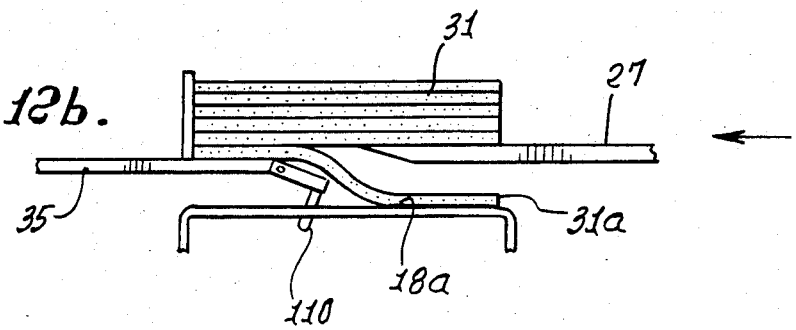
Figure 12C:
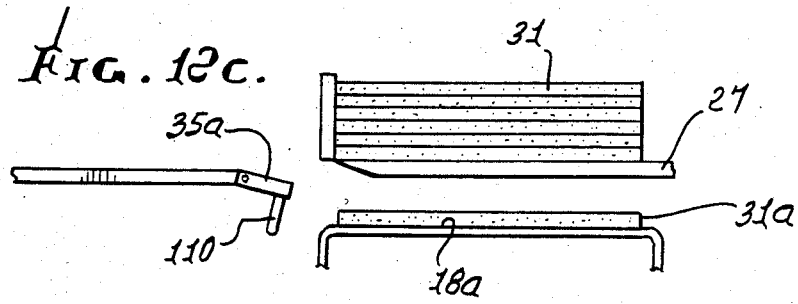
Figure 12D:
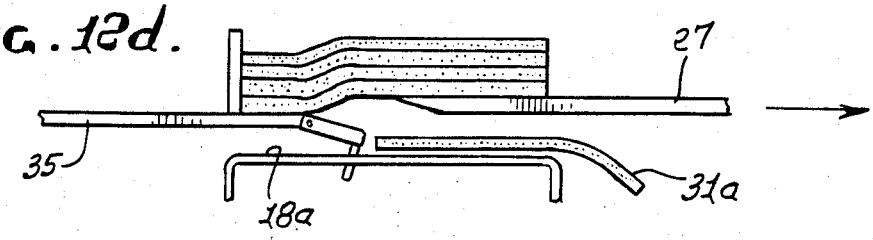
Figure 12E:
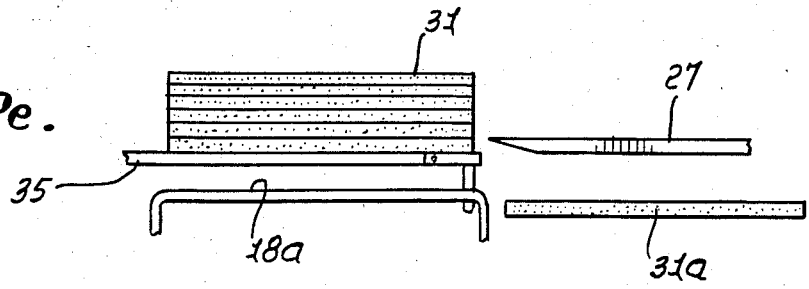

Referring to FIGS. 2, 3 and 7, the apparatus 10 is shown to include a carriage frame including two laterally spaced U-shaped members 14 extending in upright, longitudinal planes. Each member includes a lower horizontal rod or bar 15 and bars 16 extending upright from opposite ends of bars 15. Handles 17 are provided at the upper ends of bars 16. Multiple plates 18 are carried by the lower bars and extend laterally in upright parallel planes so that the top edges 18*a* of the plates define a slide plane along which shingels are slidable, laterally, one after another. A roller 20 is supported at the underside of the frame to extend laterally as shown. Axles 21 at opposite ends of the roller may be supported by bars 15. The roller may have an elastomeric surface to frictionally engage the roof and prevent lateral sliding of the apparatus, as it is moved longitudinally.

Figure 6:
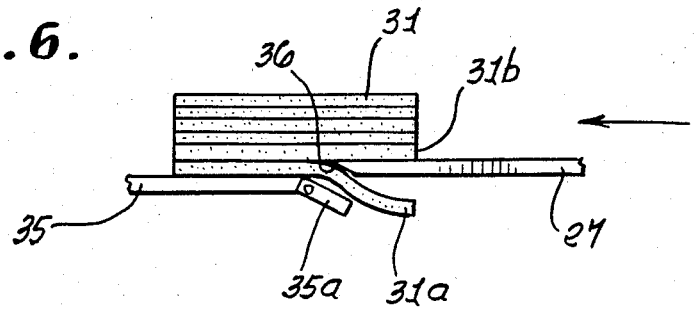

Extending between one pair of upright bars 16 in a rod 23 that carries a longitudinally extending stop plate 24. The latter has depending tongues 25 that slidably interfit laterally extending grooves 26 sunk in the top surface of a longitudinally elongated blade 27 that is supported for lateral movement. See for example blade supports 28 that extends downwardly at its opposite ends. Guide rollers 29 on the support 28 engage a laterally extending rail 30 that is in turn carried by the frame. Thus the blade is movable laterally back and forth. The blade has a laterally presented sharp edge section 27*a* adapted to initially penetrate between two stacked tiles 31*a*, and 31*b*, as shown in FIG. 6, as the blade moves leftwardly.

The blade also has a laterally presented thickened edge section 27*b* adapted to spread the two shingles as the blade further penetrate laterally between them. Section 27*b* is advantageously forwardly convex, as appears in FIG. 5, and the convexity i.e. sharpness of curvature gradually increases in a direction toward section 27*a* until it becomes sharp edged, at section 27*a*. Convex section 27*b* tends to lift the upper stack 31 of tiles away from the lowermost tile 31*a* enabling the latter to progressively separate and drop down onto bar or plate edges 18*a*, i.e. in position to be displaced laterally, and off the apparatus. Edge 27*a* may also be tapered, as shown in FIG. 6.

A tile stack support plate is shown at 35, to slidably support the stack as the plate moves horizontally laterally under lowest tile 31*a*, during blade advancement laterally. See FIG. 6. Thus, a tile discharge slot 36 formed between the forward edge 27 of the blade and the rearward door 35*a* on plate 35, moves laterally to progressively pass or discharge the tile 31*a* downwardly, per FIG. 8 (*a*). During such movement, the stack of tiles is retained against a fixed upright plate 37 carried by a rod 38 connected between upright bars 16, as shown. Fixed plate 37 has lower depending tongues 37*a* that interfit grooves 40 in the upper surface of movable plate 35, whereby tiles cannot wedge between plates 35 and 37; and the same non-wedging relationship exists as between fixed plate 24 and movable blade 27. The plate 35 is mounted on supports 44 that extend downwardly to carry guide rollers 45. The latter also engage the rail 30, so that the plate is movable back and forth, laterally.

After a tile 31*a* has dropped onto lateral edges 18*a*, (see FIG. 8(*b*) it is displaced laterally by a pusher or pushers 38. See also FIGS. 7 and 10. The pushers are mounted on a longitudinal support 39, to project upwardly between plates or bars 18, and to engage the edge 31*a*' of the tile 31*a* dropped down onto the edges 18*a*. The pusher or pushers move in synchronism with blade movement, laterally, so that the pusher is in position to displace the tile laterally once it has completely freed itself from the stack, and dropped onto the edge 18*a*. To this end, the opposite ends of the pusher support 39 carry slide blocks 40 slidable. along guide rods 41 that extend laterally between the frames as seen in FIGS. 2 and 10.

The pusher 38 and blade are interconnected so that when the pusher is moved in one lateral direction, the blade moves in the opposite lateral direction, whereby the blade retracts relative to the shingles as the pusher pushes the dropped (one) shingle laterally to discharge off the side of the carriage. For this purpose, a cable or line 50 turned about two pulleys 51 and 52 is connected to the blade, pusher and plate 35 as shown at 53, 54 and 55. Pulleys 51 and 52 are suitably carried by the fixed frame. Thus, as the blade and plate 35 travel to the left in FIGS. 2, 8(*a*) and 8(*b*), the pusher moves to the right, into position to engage the rightward edge of the dropped tile, as seen in FIG. 8(*b*); and as the blade retracts to the right in FIGS. 8(*c*) and 8(*d*), along with carriage movement to the right, the pusher moves or displaces the dropped tile to the left, to discharge off the carriage. FIG. 8(*d*) shows completed discharge.

A drive for these components is seen to include motor 56, shaft 57, gears 58 and 59, and gears 60 and 61, the drive actually moving the plate 35 which in turn moves the cable system. The plate 35 and blade 27 may be directly connected by structure or link 68, seen in FIG. 2. Trigger switches 70 are located on the handles to start and stop the motor.

The system may also be used to displace tiles off the opposite side of the carriage or frame; and to this end the pushers 38 are inverted 180° to hand downwardly, as the pusher is moved leftwardly under a dropped tile, so as the become inactive. To this end, pusher rod 39 is rotatable 180° in the guide blocks 40 at its opposite ends.

Note that the guide and transport structure shown at the end of th carriage nearest the viewer in FIG. 2 is duplicated at the opposite end of the carriage, furthest from the viewer.

Figure 11:
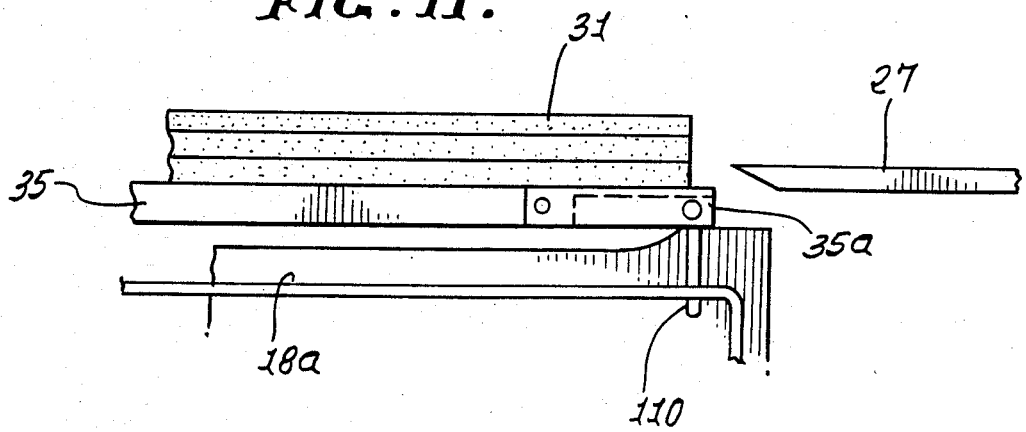

A projection or projections 110, pivotally attched to the door 35*a*, are now swing downwardly as in FIGS. 11 and 12. The blade movement sequence in FIGS. 12(*a*)–12(*e*) is the same as in FIGS. 7 and 8(*a*) to 8(*d*); however, the projection 110 now becomes the effective pusher. Note that it moves in synchronism with the blade, and in the same direction therewith, to push the dropped tile rightwardly off the edges 18*a*, as in FIGS. 12(*d*) and 12(*e*). FIG. 11 shows a cam plate to raise and lower the door 35*a*.

Finally, shingle staplers 75 are carried by the frame in a position to staple the displaced shingle to the roof after it is freed from the apparatus. When lowered from raised position seen in FIG. 2, as by rotation of stapler mounting rods 76, the staplers are positioned just above the discharged shingles, to staple them to the roof. Rods 76 are rotatably end connected at 77 to the uprights 16.

Heated balde 27 is well suited to separating tiles or shingles that are stuck together. Blade 27 may be electrically heated, as by internal wires 85.

I claim:

1. Roofing apparatus comprising:

(a) a longitudinally elongated blade having a laterally presented sharp edge section adapted to initially penetrate between two stacked shingles, and a laterally presented thickned edge section adapted to spread the two shingles as the blade further penetrates laterally therebetween, (b) and means to separate one of the two relatively spread shingles from the other by movement of the one shingle in a direction generally parallel to the other.

2. The apparatus of claim 1 including means for heating said blade so as to transfer heat from the blade to the shingles.

3. The appartus of claim 1 wherein said thickened edge section is forwardly convex.

4. The apparatus of claim 1 wherein said (b) means includes a pusher to push said one shingle in said direction after the blade has initially penetrated between the two shingles, and a carriage carrying said pusher and said blade.

5. The apparatus of claim 4 wherein said carriage includes means supporting a carriage frame for transport longitudinally along a roof.

6. The apparatus of claim 5 wherein said means comprises a roller projecting beneath said frame.

7. The apparatus of claim 6 wherein said roller has an elastomeric surface to grip the roof.

8. The apparatus of claim 5 including a shingle stapler carried by the frame in a position to staple to the roof said one shingle after it has been pushed by the pusher in said direction to free the one shingle from the frame.

9. The apparatus of claim 8 including a rotary mounting member connecting the stapler to the frame.

10. The apparatus of claim 5 wherein the pusher is supported for cyclic movement laterally of the frame.

11. The apparatus of claim 10 wherein the pusher and blade are interconnected so that when the pusher is moved in one lateral direction, the blade moves in the opposite lateral direction, whereby the blade retracts relative to the shingles as the pusher pushes said one shingle laterally to discharge off one side of the carriage.

12. The apparatus of claim 11 wherein the pusher is movable between a first position to function as defined in claim 11 and a second position in which the pusher pushes the shingle laterally to discharge off the opposite side of the carriage.

13. The apparatus of claim 5 wherein the frame includes two U-shaped members, handles on said members, each U-shaped member extending in a longitudinal upright plane, and shingle slide support means having lateral upright edges, carried by said U-shaped members.

14. The apparatus of claim 11 including a drive to effect said mount of the pusher and blade.

15. Roofing apparatus comprising (a) a frame movable on a roof, (b) a support plate on the frame and carrying a stack of shingles, (c) a blade movable toward the shingles to penetrate therebetween as the support plate also moves in the same direction as the blade, whereby a shingle below the blade drops below the blade and plate, and onto a slide surface, and (d) a pusher movable to discharge the dropped shingle off said slide surface, and onto a roof.

* * * * *